US007075042B2

(12) United States Patent
Kirby

(10) Patent No.: US 7,075,042 B2
(45) Date of Patent: Jul. 11, 2006

(54) SOLID STATE HEATER ASSEMBLY, HEATER SUBASSEMBLY AND METHODS OF ASSEMBLY

(75) Inventor: Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 287 days.

(21) Appl. No.: 10/674,394

(22) Filed: Oct. 1, 2003

(65) Prior Publication Data

US 2005/0072773 A1 Apr. 7, 2005

(51) Int. Cl.
*H05B 3/08* (2006.01)

(52) U.S. Cl. ..... 219/541; 219/458.1

(58) Field of Classification Search ..... 219/538, 219/541–544, 546–550, 552–553, 458.1, 219/459.1; 439/373, 395–404, 417–419, 439/685; 174/16.3; 338/322, 329
See application file for complete search history.

(56) References Cited

U.S. PATENT DOCUMENTS 3,447,121 A 5/1969 Cunningham et al.
3,696,232 A * 10/1972 Salinger ..... 219/507
3,940,591 A * 2/1976 Ting ..... 219/544
3,996,447 A 12/1976 Bouffard et al.
4,058,789 A 11/1977 Bavisotto et al.
4,236,065 A 11/1980 Yashin et al.
4,548,456 A 10/1985 Robertson
4,773,876 A * 9/1988 Nakamura et al. ..... 439/417

FOREIGN PATENT DOCUMENTS

GB 2242579 A 10/1991

OTHER PUBLICATIONS

Eichenauer Catalogue; Electrical Heating Elements; 1995.

* cited by examiner

*Primary Examiner*—Tu Hoang
(74) *Attorney, Agent, or Firm*—Clark & Brody

(57) ABSTRACT

A solid state heater uses a heater subassembly employing a terminal block, terminals and a PTCR or NTCR heater. The terminals engage and make electrical contact with the heater, thus eliminating the need for a rigid heater housing. The heater subassembly can be formed into a soft body or rigid body heater for heating purposes. The soft body heater uses a soft casing that envelops the heater subassembly with the casing expanding upon heating to provide a snug fit during use. The heater subassembly can be inserted in the cavity of either a soft body or a rigid body with potting compound filling any remaining voids, and the rigid or soft body can then be used for heating purposes.

20 Claims, 3 Drawing Sheets

SOLID STATE HEATER ASSEMBLY, HEATER SUBASSEMBLY AND METHODS OF ASSEMBLY

FIELD OF THE INVENTION

The present invention is directed to a solid state heater, and in particular to a solid state heater having a heater subassembly that permits integration with rigid or soft bodies for heater applications.

BACKGROUND ART

The use of solid-state materials as heaters is well known in the industry. U.S. Pat. No. 4,236,065 to Yashin et al. is one of many that describe this technology. In particular, there are in use today two types of solid-state heaters, positive temperature coefficient of resistance (PTCR) and negative coefficient of resistance (NTCR) heaters.

It is well known in the industry that a heater can be made with either of the two materials formed as a solid pellet with flat surfaces on opposite sides. The flat surfaces are coated with a metal that forms an electrical bond with the PTCR or NTCR body. When opposite polarity electrical connections are made to the two opposed metallic surfaces, current will flow through the body of the material and the resistive characteristics of the substance produces heat.

In the industry, electrical connection may be made by three methods. The first and less common method is to use a high temperature soldered connection or a brazed connection directly to the metal surfaces of the either the NTCR or the PTCR pellet. The second way is to attach two electrical lead wires each to its own metal plate, with each metal plate having approximately the same or even larger surface area than the heater, then to attach the metal plates, one to each side of the PTCR or NTCR body. The third is to attach each lead wire to metal terminals, and by some method apply sufficient force so the terminals press against the two metal surfaces, one terminal on one side and the second on the opposite side. Of course, the application of the proper sized electrical power source will produce the desired heating effect in each of the three cases above.

One method of encapsulating any one of the heater subassemblies described above is to use a molding material that produces either a soft body or a rigid body solid-state heater assembly. For example the use of silicone rubber results in a soft heater body and some epoxy materials can produce a more rigid body. Both methods of encapsulating various types of electronic components are well known. See "Electric Heating Elements", 1995 edition, P.111–P.125, Fritz Eichenauer GmbH+Co.KG.

One type of PTCR heater is made to conduct heat to the inner surfaces of a metal well that is shaped as a cylinder with one end open and the other end closed. The outer surfaces of the well are in contact with a media to be heated. In order for the PTCR material to produce heat, electrical power must be delivered by leads that contact the metal surfaces as outlined above. In the present day technology, spring type metal terminals are attached to each of two lead wires using conventional crimping techniques. The terminals, with wires attached, are inserted into a heater case made of a ceramic material that contains a previously inserted solid pellet of PTCR material with metallic surfaces. The ceramic has a special shaped hole which centers the PTCR pellet and presses the spring type terminals against the pellet's metal surfaces. A "potting" compound is inserted into the open end of the ceramic shell filling the cavity and sealing the heater and the insulated lead wires. The hard shell of the ceramic heater must be sufficiently smaller than the inside dimensions of the metal well that it is to be placed in to prevent overlapping production tolerances from creating an interference.

To ensure the desired heating effect, a high temperature grease is used to coat the ceramic heater body and contact the well's inner surface, thus permitting heat transfer from the rigid ceramic case to the well. Without this grease, the PTCR heater would not produce the necessary temperature rise in the media being heated and could possibly result in system failure.

The electrical connection methods exhibited by the prior art are difficult and expensive. Brazing involves fluxes and high temperature solders having heavy metals which are dangerous and their use in manufacturing is banned in some areas.

For the ceramic case type PTCR heater noted above, there are a number of other issues that create problems. Though the rigid ceramic case provides a means to hold spring type terminals securely to the metallic surfaces of a heater pellet, the nature of ceramic bodies is that it is virtually impossible to manufacture heaters without some being too large to be inserted in a well or the like and some so small they would not contact the inner well surfaces sufficiently to properly conduct the heat generated. As mentioned previously, to ensure all heaters made with ceramics will fit into the intended openings all must be made so that the largest tolerance heaters will fit into the smallest tolerance openings.

As noted in the prior art for ceramic case heaters, the practice of manufacturing undersize ceramic cases and using a grease to promote heat conduction is costly as well as undesirable because the grease tends to cause a dirty work environment. Over time and with the heaters under operating conditions, it is also possible for the grease to flow out of the shell being heated thus reducing the amount of heat conducted. Further, any remaining thermal grease will harden and crack over time at elevated temperatures. This phenomenon has the deleterious effect of reducing the temperature of the media being heated.

In light of these problems noted above, a need has developed for a solid-state heater that is economical to produce and has a soft or semi-rigid body that will expand when it generates heat so as to tightly contact the inner surface of the well to be heated. Such a heater will eliminate the need for expensive and messy thermally conductive grease used today. The new invention described below addresses the above need and can also be used in the construction of ceramic case solid-case heaters.

SUMMARY OF THE INVENTION

A first object of the present invention is an improved solid state heater and heater subassembly.

Another object of the invention is a solid state heater that eliminates the need to use grease or other lubricants during heater manufacture.

Yet another object of the invention is a solid state heater that eliminates the need for specially formed surfaces in a heater housing that are required to insure proper electrical contact for heater components.

A still further object of the invention is an improved method of making the solid state heater and subassembly.

One other object of the invention is a heater subassembly that can be used in soft or rigid bodies for heater use.

Other objects and advantages of the present invention will become apparent as the description thereof proceeds.

In satisfaction of the foregoing objects and advantages, the present invention is an improvement in solid state heaters. One aspect of the invention involves a solid state heater subassembly. The subassembly comprises a block configured to retain a pair of terminals in a spaced apart relationship to hold a PTCR or NTCR heater in electrical contact. This is accomplished by having bores in the block to receive the terminals and open slots to allow spring portions of the terminals to extend from the block and provide biasing surfaces to hold the heater in place.

The block can hold the terminals in any number of ways; a preferred mode using stops on a face of each slot and a tang-containing terminal. The tang can engage the stop once the terminal is inserted into the block to prevent terminal removal.

The heater subassembly, once assembled, can then be used to make a soft body heater or a rigid body heater. For the soft body heater, a soft material such as a rubber or rubber-like compound, e.g., silicone rubber, is molded or otherwise formed around the heater subassembly and into a desired shape such as a cylinder. The casing can completely envelop the heater subassembly, or only partially envelop it, with potting or molding compound covering the remaining areas and completing the desired shape of the heater. When the casing does not entirely envelop the heater subassembly, the casing can be first formed with a stepped cavity shaped to receive both the heater and the terminal block. The potting/molding compound can then cover the remaining portion of the heater subassembly and complete the desired heater shape.

When making a rigid body heater, the rigid body is formed with a cavity to receive the heater subassembly, and the potting compound is used to fill in any voids and complete the heater shape.

The invention also entails the method of forming the heater subassembly and soft/rigid casing, and the block/terminal combination.

BRIEF DESCRIPTION OF THE DRAWINGS

Reference is now made to the drawings of the invention wherein.

DESCRIPTION OF THE PREFERRED EMBODIMENTS

Figure 1:
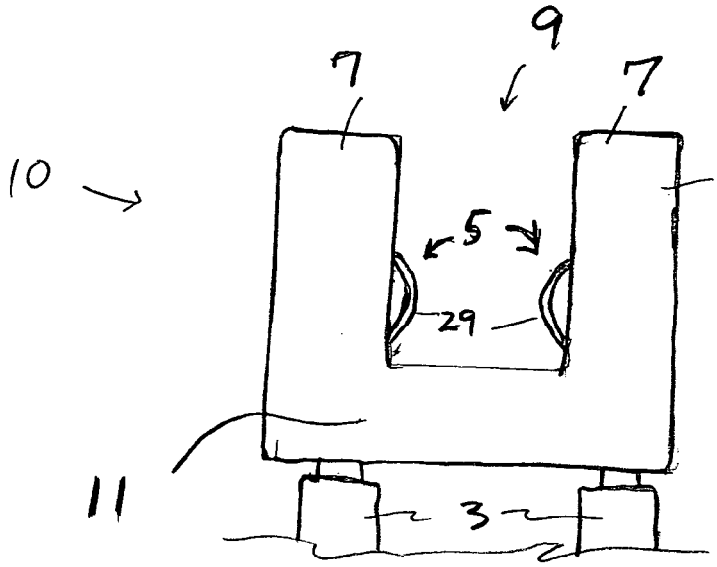
FIG. 1 is a side view of one embodiment of the invention.

The present invention offers a number of advantages over the current state of the art solid state heaters. One advantage is the elimination of the problem with manufacturing tolerances when making the heater. In contrast to the prior art techniques wherein specially sized openings had to be formed in rigid housing to ensure electrical contact between lead terminals and the heater material, the present invention eliminates such openings. The present invention also eliminates the use of grease and its attendant costs in terms of manufacturing. Using the invention improves the heater performance since the expansive nature of the soft body heater casing assures good contact with an adjacent heat conducting surface, and without the need for high temperature grease.

The invention covers several aspects of solid state heaters. One aspect of the invention is a solid state heater subassembly that eliminates the need to form specifically shaped openings in a rigid housing to form good electrical contact between lead wire terminals and the metal plates of the PTCR or NTCR material, (the "heater material"). While the characteristics of these two types of two materials used result in different heater characteristics, either is adaptable for use in the present invention. The subassembly utilizes a unique terminal block construction that is designed to receive and retain spring terminals of the lead wires. The block is also configured to receive the heater material in such way that the spring terminals engage the metal contacts of the heater material and keep the heater material and block together. The spring terminals connect to lead wires for powering of the heater material.

The heater subassembly can then be used in a number of ways. In one mode, the heater subassembly is used in conjunction with a soft or semi-rigid casing that surrounds the subassembly and which is capable of expanding upon heating to ensure a good fit when placed in a well or other location. By eliminating the need to form specially configured surfaces in a rigid body for electrical contact, this soft body heater can be made inexpensively, and also avoids the need for grease to accommodate tolerance differences between rigid housings and the heater material.

In one mode, the soft body casing can completely envelop the heater subassembly, e.g., molded around it, with the lead wires extending through the casing for ultimate power connection. In an alternative mode, the casing can be first formed with a cavity, and the heater subassembly can be inserted in the cavity. The remainder of the cavity can be filled with a potting or molding compound to form the soft body heater, with the lead wires extending through the potting compound. While the casing is shown with a cylindrical configuration in the drawings, the casing can have virtually any shape that would be required for a particular heating application.

The soft body heater can then be inserted into any well or other opening for heating purposes as would be within the skill of the art.

In yet another mode of the invention, the heater subassembly could be used in conjunction with a rigid housing to form a rigid body heater. In this mode, the rigid housing is formed with an opening sized to receive the block of the subassembly. Since the block already makes the electrical connection between the heater material and the spring terminals, the opening in the rigid housing does not require any intricate shapes or close tolerances as are used in the prior art, see for example, the Yashin patent discussed above. Once inserted into the rigid housing, potting or molding compound can fill the remaining voids to form the heater for use. The rigid body heater can then be inserted into the appropriate location for heating purposes.

The potting or molding compound can be any type used in solid state heaters, including those disclosed in the Yashin patent and others known to those of skill in the art. The material to form the soft or semi-rigid casing can be any material capable of withstanding the heater operation conditions, and being molded or otherwise formed around the heater subassembly or in such a shape to permit receiving the subassembly and subsequently sealing thereof into the soft body heater. Examples of this material include those disclosed in the "Electrical Heating Element" publication noted above.

Referring now to FIG. 1, one part of an exemplary heater subassembly is designated by the reference numeral 10 and is seen to include a terminal block body 1, insulated lead wires 3 and spring terminals 5. The block body 1 is U-shaped with a pair of legs 7 forming a slot 9, and cross member 11 spanning the width of the block body 1 and connecting the legs 7.

Figure 2A:
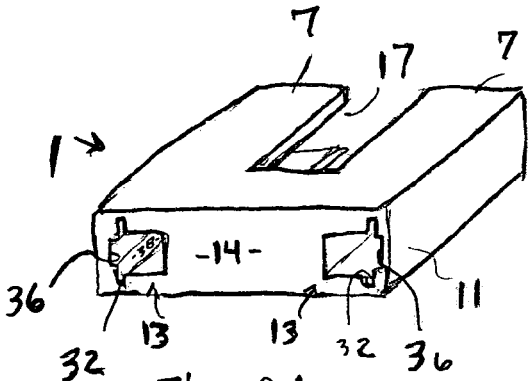
FIG. 2A is a top perspective view of the terminal block of FIG. 1.
Figure 2B:
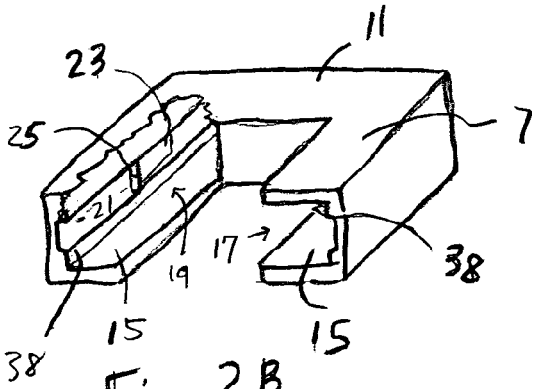
FIG. 2B is a bottom perspective view of the terminal block of FIG. 1 with a portion cut away to show more detail.

FIGS. 2A and 2B show the block body 1 in more detail whereby cross member 11 has a pair of bores 13. One end of each bore 13 is positioned on face 14 and acts as an entry point for insertion of the spring terminals 5 into the block body 1. Each bore 13 extends through the cross member 11, with the bore changing into a channel 15 formed in each leg. The channel 15 is u-shaped to guide and hold the spring terminal 5, with opening 17 of each channel 15 facing the slot 9. The configuration of the bore 13 will be described below in conjunction with the description of the terminals 5.

Each channel 15 also has a raised stop 19 located along a back surface 21 of the channel. The stop 19 has a ramp portion 23, which terminates at step 25.

Figure 3:
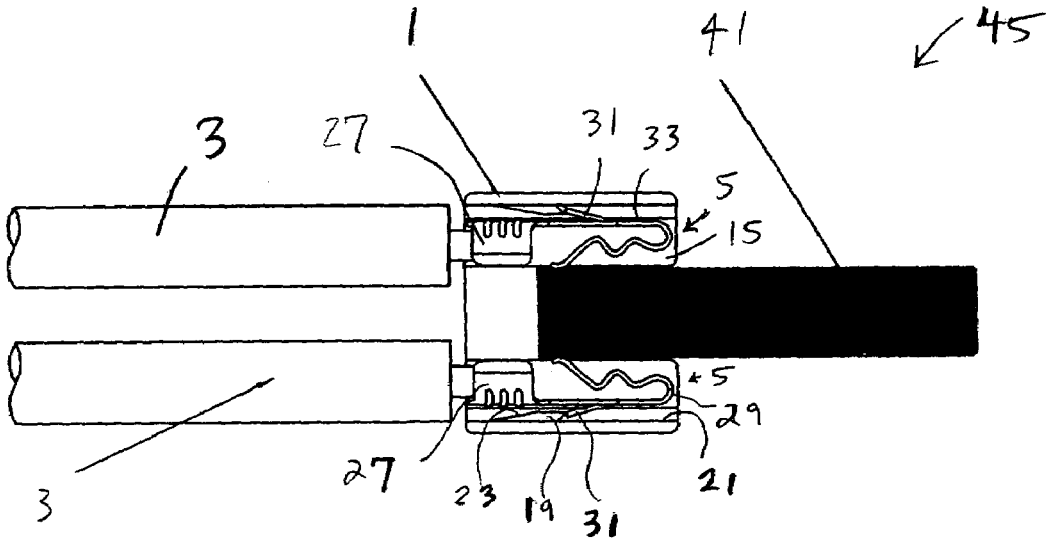
FIG. 3 is a side view of one embodiment of the heater subassembly of the invention.

To assemble the block body 1 and terminals 5 while still referring to FIGS. 1–3, each lead wire 3 is first crimped to each end of the spring terminal 5 using the crimping flaps 27 using conventional crimping methods. Once each lead wire 3 is connected to its respective spring terminal, the terminal 5 is inserted into the bore 13 with the spring 29 of the terminal extending into the channel 15, with the crimped connection remaining in the bore 13. Because of the spring bias in the terminal 5, the spring 29 compresses when passing through the bore 13, and expands beyond the confines of the channel 15 as shown in FIG. 1. The spring terminal 5 also has a tang 31 protruding from a back side 33 of the terminal 5. During terminal insertion, the tang 31 (in a compressed state) rides over the ramp 23 until the tang 31 passes the step 25 and expands to its natural position. The step 25 locks the spring terminal 5 in place by preventing reverse movement of the terminal 5. Further travel of the spring terminal through the bore 13 is checked by the insulation on lead wires 3 contacting the face 14.

Referring back to FIG. 2A, the bore 13 is configured to allow travel of the various parts of the spring terminal 5. Each bore 13 includes opposing slots 32 which receive the wide parts 34 of the terminal 5. The slots 32 extend through the bore 13, and open into the channel 15 to leave just the lip 38. The recess 36 in the bore 13 forms surface 21 containing the stop 19, surface 21 accommodating travel of the tang 31. The wide parts 34 of the terminal ride on lips 38. The bore 13 is also sized to receive the crimping flaps 27 and the uninsulated end of the lead wire.

Figure 4:
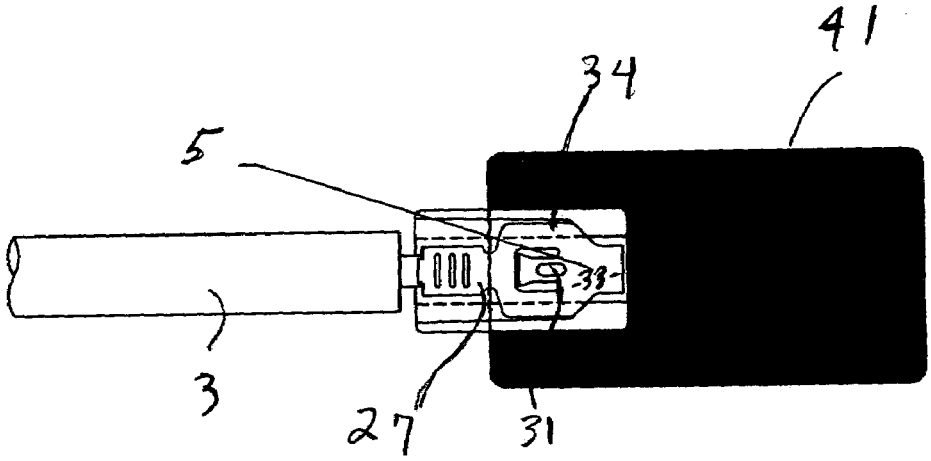
FIG. 4 is a top view of the heater assembly of FIG. 3.

Referring now to FIGS. 3–4, a PTCR or NTCR heater 41 is shown positioned in the slot 9. The terminal springs 29 engage the metal sides (not shown) of the heater 41; thus forming the heater subassembly 45. The block body 1 resists movement of the spring terminals 5 such that the springs 29 are compressed when the heater 41 is inserted in the slot 9, the spring force acting upon the heater 41 to make the necessary electrical contact.

Figure 5:
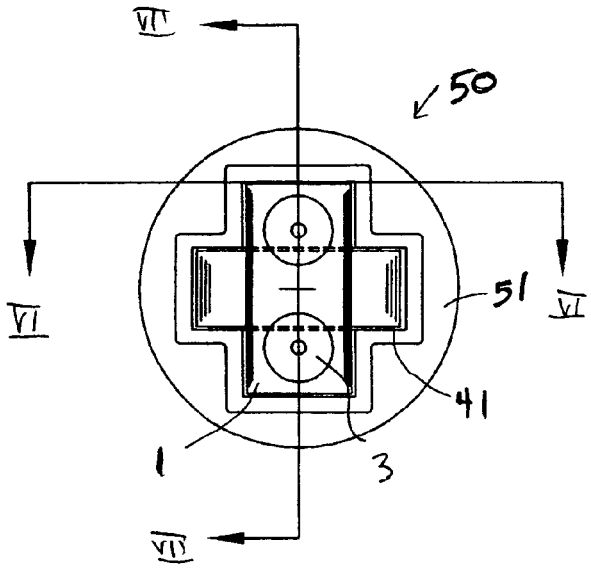
FIG. 5 is a top view of one embodiment of a soft body heater of the invention.
Figure 6:
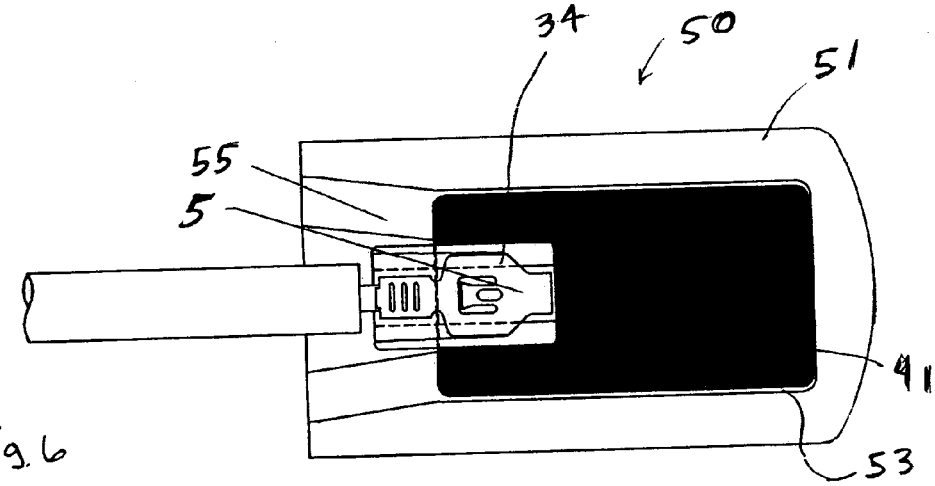
FIG. 6 is a view along the line VI—VI of FIG. 5.
Figure 7:
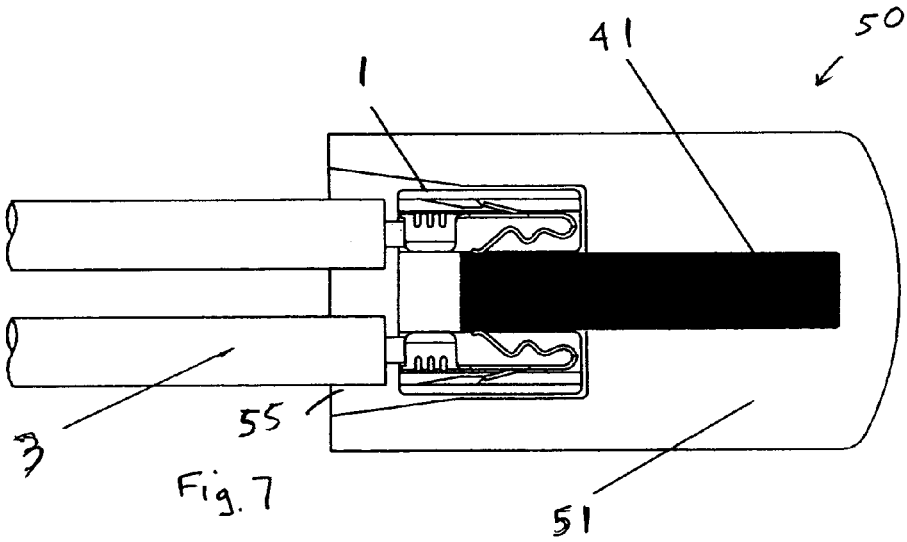
FIG. 7 is a view along the line VII—VII of FIG. 5.

Once assembled, the heater subassembly 45 has as a number of applications. One application is a soft body heater 50 as shown in FIGS. 5–7. The soft body heater 50 includes the heater subassembly 45 and a semi-rigid or soft casing 51. The casing 51 is first molded or otherwise formed with a stepped cavity 53 to receive the heater 41 and the block body 1 as the heater subassembly 45. Then, a potting or molding compound 55 can be employed to completely encase the subassembly 45 to form the soft body heater 50. As shown in FIGS. 5–7, a part of the lead wires 3 are encased by the potting compound 55 so that the heater subassembly 45 is isolated. The material used for the flexible casing can be made of any material that is flexible, moldable, and capable of withstanding the condition under which the heater operates. These materials include rubber or rubber type materials like those discussed in the "Electrical Heating Elements" discussed above. Likewise, the molding compound is well known in the field of solid state heaters, and any known type can be employed.

In another embodiment, the soft body heater 50 as shown in FIG. 5 could be formed by molding the soft material completely around the heater subassembly, thus eliminating the need for first forming the casing with a cavity to receive the subassembly, and then using the potting/molding compound to fill any remaining voids.

In yet another embodiment, the heater subassembly could be used in a rigid casing or housing having a shape similar to that shown in FIGS. 6 and 7. More specifically, the casing 51 would be formed from a rigid material such as a ceramic or the like. As with the soft body heater 50, the heater subassembly 45 would be inserted into the cavity and the unoccupied cavity volume would be filled with the potting compound thus forming a rigid body heater. Unlike the prior art heaters, this assembly technique does not require forming intricate openings in the rigid housing to both hold and make terminal contact with the heater material.

The material for the block body 1 of the heater subassembly is made of a material that is non-conductive or electrically insulating. The material should also be able to withstand the operating conditions of the heater itself by having sufficient dielectric strength, corrosion resistance, and high temperature strength. One example is a polyphenylene sulfide that is glass and mineral filled, and has a grade of Ryton (R-7). Of course, other materials that have the necessary insulating properties and can function under the heater operating conditions can be used such as high temperature polymers, ceramics and composites. The block body is preferably molded into its shape, but it can be made using any known techniques for forming these types of materials. Also, while the block is u-shaped overall with u-shaped channels and a rectangular cross beam, other shapes could be employed as long as the spring terminals are exposed to contact the heater material to make the necessary electrical contact.

Once the soft body heater 50 is formed, it can be used in any application requiring the application of heat. For example, it could be inserted into a well so that heat is conducted to a heat conducting surface of the well and elsewhere as need be. The heat conducting surface can be virtually any surface that conducts the heat emanating from the heater for heating purposes. Similarly, the rigid body heater can be used in any known fashion.

While the block 1 uses a stop 19 to retain the spring terminal 5 in place, other methods could be employed to ensure that the terminal does not slip out of the block. Fasteners, adhesives, other configured slots and combinations thereof could be used.

Again, the heater subassembly is advantageous in that it is capable of ensuring that the proper electrical contact is made between the heater material and terminals of the wires without having to rely on a rigid casing as is the case in prior art heaters. Providing such a heater subassembly allows dual application use via soft body heaters wherein the soft casings expansion properties allows it to be used without grease or the like and rigid body heaters that do not require intricate shapes to assure electrical connection.

As such, an invention has been disclosed in terms of preferred embodiments thereof which fulfills each and every one of the objects of the present invention as set forth above and provides a new and improved solid state heater, heater subassembly, and methods of making.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A heater subassembly for a solid state heater comprising:

a block body having a slot sized to receive a solid state heater material, the block body including a pair of opposing openings with the slot disposed therebetween, each opening in communication with one end of a bore in the block body, another end of the bore terminating in a terminal entrance;

a pair of terminals, one end of each terminal connected to a lead wire, the other end of each terminal including a spring, each terminal positioned in each bore, with a portion of each spring extending beyond the opening and into the slot; and a heater made of a PTCR material or a NTCR material, a portion of the heater disposed in the slot and retained in place by the springs of the terminals.

2. A soft body heater comprising:

a) a heater subassembly including:

a block body having a slot sized to receive a solid state heater material, the block body includina a pair of opposing openings with the slot disposed therebetween, each opening in communication with a bore in the block body, each bore terminating in a terminal entrance;

a pair of terminals, one end of each terminal connected to a lead wire, the other end of each terminal including a spring, each terminal positioned in each bore, with a portion of each spring extending beyond the opening and into the slot; and a heater made of a PTCR material or a NTCR material, a portion of the heater disposed in the slot and retained in place by the springs of the terminals; and either b) a soft casing completely surrounding the heater subassembly with the lead wires extending through the soft casing for connection to a power source or a soft casing surrounding a portion of the heater subassembly, a remaining portion of the heater subassembly covered by a molding compound.

3. The soft body heater of claim 2, wherein the soft casing surrounds the portion of the heater subassembly, the remaining portion of the heater subassembly covered by the molding compound.

4. The soft body heater of claim 3, wherein the soft casing is molded around the heater subassembly.

5. The soft body heater of claim 4, wherein the soft casing is formed with a cavity sized to receive the heater subassembly, the molding compound filling remaining portions of the cavity not occupied by the heater subassembly.

6. A rigid body heater comprising:

a) the heater subassembly of claim 1; and b) a rigid body having a cavity sized to receive the heater subassembly and envelop a portion thereof, a remaining portion of heater subassembly covered by a molding compound.

7. The heater assembly of claim 1, wherein each opening is formed by a channel in the block body, each channel including a stop, with each spring terminal including a tang, the tang positioned on the terminal to engage the stop once the terminal is inserted to prevent removal of the terminal from the block.

8. The soft body heater of claim 2, wherein each opening is formed by a channel in the block body, each channel including a stop, with each spring terminal including a tang, the tang positioned on the terminal to engage the stop once the terminal is inserted to prevent removal of the terminal from the block.

9. The soft body heater of claim 3, wherein each opening is formed by a channel in the block body, each channel including a stop, with each spring terminal including a tang, the tang positioned on the terminal to engage the stop once the terminal is inserted to prevent removal of the terminal from the block.

10. The rigid body heater of claim 6, wherein each opening is formed by a channel in the block body, each channel including a stop, with each spring terminal including a tang, the tang positioned on the terminal to engage the stop once the terminal is inserted to prevent removal of the terminal from the block.

11. A method of making a soft body heater comprising the steps of:

a) providing a heater subassembly including:

a block body having a slot sized to receive a solid state heater material, the block body including a pair of opposing opening with the slot disposed therebetween, each opening in communication with a bore in the block body, each bore terminating in a terminal entrance;

a pair of terminals, one end of each terminal connected to a lead wire, the other end of each terminal including a spring, each terminal positioned in each bore, with a portion of each spring extending beyond the opening and into the slot; and a heater made of a PTCR material or a NTCR material, a portion of the heater disposed in the slot and retained in place by the springs of the terminals;

and b) forming a soft casing entirely around the heater subassembly or forming the soft casing with a cavity, inserting the heater subassembly into the cavity, and using a molding compound to cover a remaining portion of the heater subassembly.

12. The method of claim 11, wherein the soft casing is molded entirely around the heater subassembly.

13. The method of claim 11, wherein the soft casing is formed with the cavity, the heater subassembly is inserted in the cavity and the molding compound covers the remaining portion of the heater subassembly.

14. A method of making a rigid body heater comprising the steps of:

a) providing the heater subassembly of claim 1; and b) forming a rigid casing with a cavity;

c) inserting the heater subassembly into the cavity; and d) using a molding compound to cover a remaining portion of the heater subassembly.

15. A heater subassembly terminal block comprising:

a) a block body having a slot sized to receive a solid state heater material, the block body including a pair of opposing openings with the slot disposed therebetween, each opening in communication with one end of a bore in the block body, another end of the bore terminating in a terminal entrance; and a pair of terminals, one end of each terminal connected to a lead wire, the other end of each terminal including a spring, each terminal positioned in each bore, with a portion of each spring extending beyond the opening and into the slot.

16. The terminal block of claim 15, wherein each opening is formed by a channel in the block body, each channel including a stop, with each spring terminal including a tang, the tang positioned on the terminal to engage the stop once the terminal is inserted to prevent removal of the terminal from the block.

17. The terminal block of claim 15, wherein the block body has legs and a cross member forming a u-shape, with the openings positioned in the legs and the bores positioned in the cross member connecting the legs.

18. The heater subassembly of claim 1, wherein the block body has legs and a cross member forming a u-shape, with the openings positioned in the legs and the bores positioned in the cross member connecting the legs.

19. The terminal block of claim 15, wherein each bore includes a slot wider than the bore to accommodate wide portions of the terminal.

20. The heater subassembly of claim 1, wherein each bore includes a slot wider than the bore to accommodate wide portions of the terminal.

* * * * *